US008662816B2

(12) United States Patent
Grimes et al.

(10) Patent No.: US 8,662,816 B2
(45) Date of Patent: Mar. 4, 2014

(54) Z-BAR LINKAGE FOR WHEEL LOADER MACHINES

(75) Inventors: Joel R. Grimes, Fuquay-Varina, NC (US); Wayne E. Harshberger, Oswego, IL (US); Jason J. Hagedorn, West Chicago, IL (US); Jia X. Zhao, Chicago, IL (US); Susan Green, Oswego, IL (US); Jay H. Renfrow, Kenly, NC (US)

(73) Assignee: Caterpillar Inc., Peoria, IL (US)

( * ) Notice: Subject to any disclaimer, the term of this patent is extended or adjusted under 35 U.S.C. 154(b) by 482 days.

(21) Appl. No.: 12/949,501

(22) Filed: Nov. 18, 2010

(65) Prior Publication Data

US 2012/0128456 A1 May 24, 2012

(51) Int. Cl.
*E02F 3/00* (2006.01)
*B66C 23/62* (2006.01)

(52) U.S. Cl.
USPC ..... 414/700; 414/680; 414/685; 414/701

(58) Field of Classification Search
USPC ..... 414/680, 685, 697, 700, 701, 715
See application file for complete search history.

(56) References Cited

U.S. PATENT DOCUMENTS

| | | | |
|---|---|---|---|
| 4,154,349 | A | 5/1979 | Christensen |
| 4,798,512 | A | 1/1989 | Intveld |
| 5,156,520 | A | 10/1992 | Ericson et al. |
| 6,309,171 | B1 | 10/2001 | Arck et al. |
| 6,461,099 | B1 | 10/2002 | Gosz |
| 2006/0291987 | A1 | 12/2006 | Osanai et al. |

OTHER PUBLICATIONS

Product Brochure, "904H Compact Wheel Loaders," Caterpillar, Inc., 2008 (12 pages).
Product Brochure, "906H, 907H, 908H Compact Wheel Loaders," Caterpillar Inc., 2009 (12 pages).
Product Brochure, "914G/IT14G Compact Wheel Loaders/ Integrated Toolcarriers," Caterpillar Inc., 2009 (20 pages).
Product Brochure, "924H Wheel Loader," Caterpillar, Inc., 2007 (20pages).
Product Brochure, "924Hz Wheel Loader," Caterpillar Inc., 2007 (16 pages).
Product Brochure, "928Hz Wheel Loader," Caterpillar, Inc., 2007 (16 pages).
Product Brochure, "930H Wheel Loader," Caterpillar, Inc., 2007 (20 pages).
Product Brochure, "938H Wheel Loader," Caterpillar Inc., 2008 (24 pages).
Product Brochure, "IT38H Integrated Toolcarrier," Caterpillar Inc., 2008 (24 pages).
Product Brochure, "950 H Wheel Loader," Caterpillar Inc., 2007 (28 pages).

(Continued)

*Primary Examiner* — Scott Lowe
(74) *Attorney, Agent, or Firm* — Miller, Matthias & Hull

(57) ABSTRACT

An improved Z-bar linkage for wheel loader machines for maneuvering an implement such as a bucket or pallet forks may include lift arms pivotally connected between an end frame of the machine and the implement, a tilt link pivotally connected between the implement and a tilt lever that is pivotally connected between the tilt link and the lift arms. Lift cylinders may rotate the lift arms to raise and lower the implement, and a tilt cylinder may drive the tilt lever and tilt link to rotate the implement between a dump position and a racked position. Ratios of the lengths of these kinematic elements are provided such that the good performance with one implement, such as bucket, does not result in poor performance with another implement, such as the pallet forks.

28 Claims, 8 Drawing Sheets

(56) References Cited

OTHER PUBLICATIONS

Product Brochure, "IT62H Integrated Toolcarrier," Caterpillar Inc., 2007 (28 pages).
Product Brochure, "966H Wheel Loader," Caterpillar Inc., 2007 (28 pages).
Product Brochure, "972H Wheel Loader," Caterpillar Inc., 2007 (28 pages).
Product Brochure, "980H Wheel Loader," Caterpillar Inc., 2008 (28 pages).
Product Brochure, "988H Wheel Loader," Caterpillar Inc., 2010 (24 pages).
Product Brochure, "990H Wheel Loader," Caterpillar Inc., 2008 (28 pages).
Product Brochure, "993K Wheel Loader," Caterpillar, Inc., 2007 (32 pages).
Product Brochure, "994F Wheel Loader," Caterpillar, Inc., 2010 (32 pages).
Product Brochure, "WA250-6 Wheel Loader," Komatsu America Corp., 2009 (12 pages).
Product Brochure, "WA200PZ-6 Wheel Loader with Parallel Z-Bar Linkage," Komatsu America Corp., 2008 (12 pages).
International Search Report and Written Opinion for related International Application No. PCT/US11/60725; report dated Jun. 28, 2012.

Z-BAR LINKAGE FOR WHEEL LOADER MACHINES

TECHNICAL FIELD

This disclosure relates generally to wheel loader machines and, in particular, to Z-bar linkages for articulating implements in such machines.

BACKGROUND

Wheel loader machines known in the art are used for moving material from one place to another at a worksite. These machines include a body portion housing the engine and having rear wheels driven by the engine and an elevated cab for the operator. A front non-engine end frame with the front wheels is attached to the body portion by an articulated connection allowing the end frame to pivot from side-to-side when the front wheels are turned to steer the machine. The end frame further includes linkages, such as Z-bar linkages, for manipulating an implement of the machine. A pair of lift arms coupled to the end frame are raised and lowered by corresponding lift cylinders to adjust the elevation of the implement above the ground. Where Z-bar linkages are used, the tilt of the implement (rotation of the implement about a pivot connection at the end of the lift arms) is controlled by a tilt lever and tilt link coupled between the lift arms and the implement, and driven by a tilt cylinder. An example of a wheel loader machine implementing a Z-bar linkage is provided in U.S. Publication No. 2006/0291987, published Dec. 28, 2006.

The wheel loader machines may be able to move many different types of materials depending on the requirements of the job site. Consequently, the machines are designed to manipulate different types of implements. A bucket may be the appropriate implement for moving what are considered to be loose materials, such as earth, clay, sand and gravel. When moving the loose materials from a pile to a truck, for example, the lift arms and tilt links are manipulated to place the cutting edge of the bucket parallel to the ground and near the bottom of the pile. After the bucket digs into the pile, the tilt links rack the bucket back to gather a maximum load in the bucket, and the bucket is raised out of the pile by the lift arms for transport of the material to the truck. Once there, the tilt links unrack the bucket and tilt the bucket forward to dump the load into the truck.

Pallet forks may be an appropriate implement for other types of materials, such as palletized cargo. Forks may also be appropriate for lifting cylindrical payloads like sewer pipe, telephone poles and tree trunks. For these types of payloads, full racking of the implement may rarely be necessary, and in some applications undesirable, but maintaining the forks parallel to the ground or tilted slightly upward as the lift arms are raised and lowered may be advantageous to prevent the load from sliding off the front of the forks. This may occur when the tilt angle of the forks becomes too shallow and the wheel loader machine stops suddenly. Other types of implements are also used on wheel loader machines, and may similarly have divergent movement requirements for moving the material for which they are designed.

In many implementations, the wheel loader machines are configured so that a variety of implements may be used interchangeably on a single machine. In some implementations, a universal coupler may be connected to the lift arms and tilt linkages. The implements may have corresponding connectors that mate with the coupler to attach the implement for use. As discussed above, each implement will have differing ranges of motion when moving the materials for which they are designed. In some situations, these motions may be complimentary, whereas in other situations the motions may cause conflicting requirements for the configurations of the lift arms and tilt linkages. In the designing of the wheel loader machine, the requirements of one particular implement drive the design of the lift arms and the Z-bar linkages to meet the needs of the target customers. The performance of other implements may be met by coincidence, but are typically compromised in favor of the dominant design implement. Therefore, a need exists for an improved wheel loader machine design implementing a Z-bar linkage that provides the desired performance for two or more implements, such as buckets and forks, by choice instead of happenstance.

SUMMARY OF THE DISCLOSURE

In one aspect of the present disclosure, the invention is directed to a wheel loader machine that may include an end frame, a pair of lift arms having first ends pivotally connected to the end frame by pivot pins A having a common rotational axis and having second ends opposite the first ends, a pair of lift cylinders having first ends pivotally connected to the end frame by pivot pins Y having a common rotational axis and second ends each pivotally connected to a corresponding one of the lift arms by pivot pins K having a common rotational axis, wherein extension of the lift cylinders causes the lift arms to pivot about the pivot pins A and move the second ends of the lift arms upwardly relative to the ground. The wheel loader machine may also include an implement having a material engaging portion and a coupling portion, where the second ends of the lift arms are pivotally connected to the implement proximate a bottom end of the coupling portion by pivot pins B having a common rotational axis, a tilt lever having a first end and a second end, and being pivotally connected to the lift arms at a point between the first and second ends of the tilt lever by a pivot pin F, a tilt link having a first end pivotally connected to the second end of the tilt lever by a pivot pin D and second end pivotally connected to the implement proximate a top end of the coupling portion by a pivot pin C, and a tilt cylinder having a first end pivotally connected to the first end of the tilt lever by a pivot pin E and a second end pivotally connected to the end frame by a pivot pin G, wherein extension of the tilt cylinder causes the tilt lever and tilt link to rotate the implement about the pivot pins B toward a racked position. The wheel loader machine may have a ratio of a distance DE between the pivot pins D and E to a distance EF between the pivot pins E and F in the range of 2.08-2.21.

In another aspect, the invention is directed to a wheel loader machine having an arrangement of kinematic elements as set forth in the preceding paragraph, and may have a ratio of a distance DE between the pivot pins D and E to a distance CD between the pivot pins C and D in the range of 1.44-1.59.

In another aspect, the invention is directed to a wheel loader machine having an arrangement of kinematic elements as set forth in the preceding paragraph, and may have a ratio of a distance EF between the pivot pins E and F to a distance DF between the pivot pins D and F in the range of 0.82-0.89.

Additional aspects of the invention are defined by the claims of this patent.

DETAILED DESCRIPTION

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
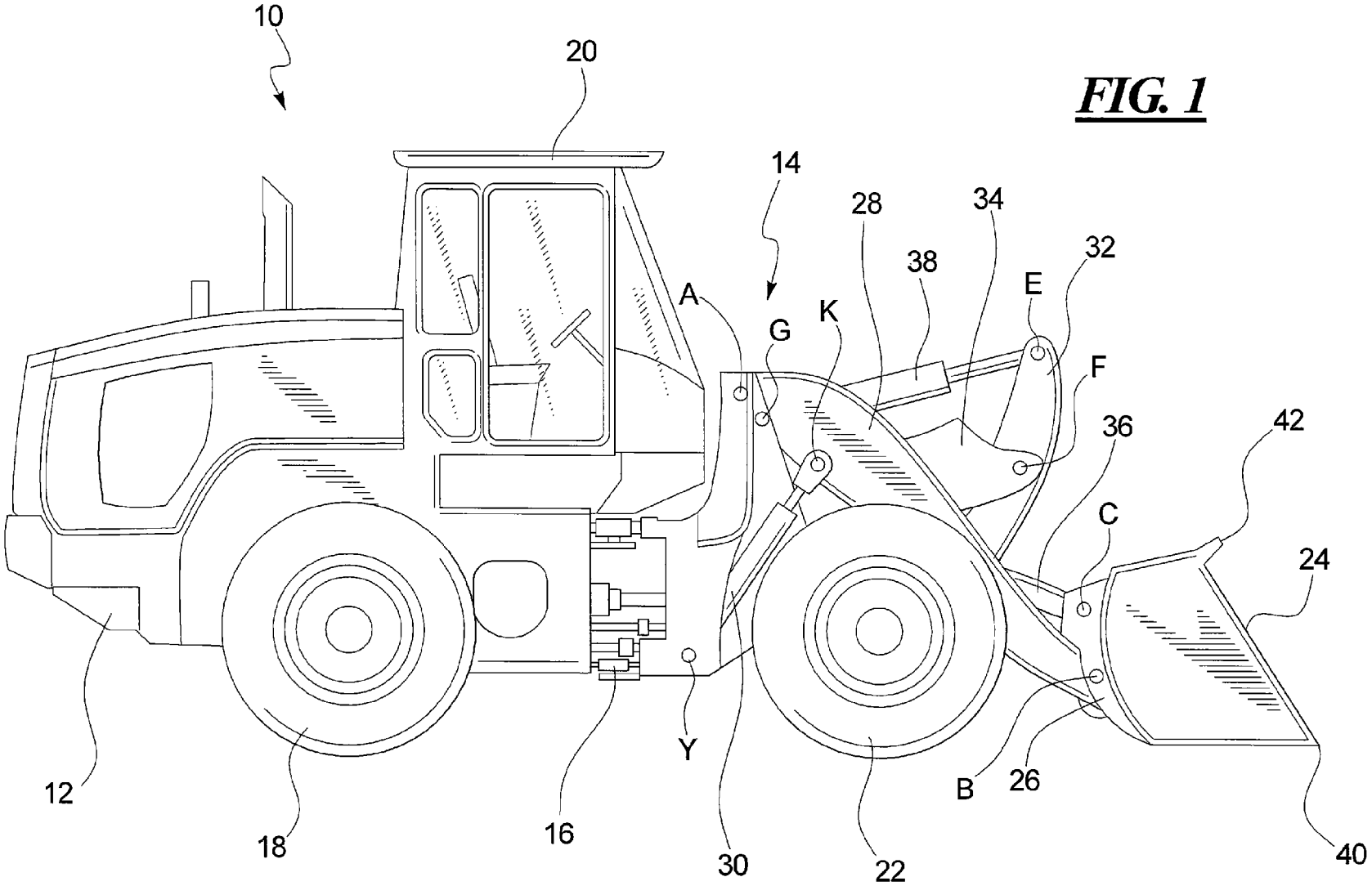
FIG. 1 is a side elevation view of a wheel loader machine in accordance with the present disclosure.

FIG. 1 illustrates an embodiment of a wheel loader machine 10 in accordance with the present disclosure. The wheel loader machine 10 includes a body portion 12 and a non-engine end frame 14 connected by an articulating joint 16. The body portion 12 houses an engine that drives rear wheels 18, and includes an elevated cab 20 for the operator. The end frame 14 has front wheels 22 that are turned by the steering mechanism, with the articulating joint 16 allowing the end frame 14 to move from side-to-side to turn the wheel loader machine 10. In the illustrated embodiment, an implement in the form of a bucket 24 is mounted at the front of the end frame 14 on a coupler 26. The bucket 24 and coupler 26 may be configured for secure attachment of the bucket 24 during use of the wheel loader machine 10, and for release of the bucket 24 and substitution of another implement. Although the coupler 26 and bucket 24 are illustrated and described as being separate connectable components, those skilled in the art will understand that each implement, including buckets, may be configured as a unitary component having a material engaging portion, such as the bucket or forks, and a coupling portion having the points of attachment for connecting the implement to the machine 10.

The coupler 26 is connected to the end frame 14 by a pair of lift arms 28. One end of each lift arm 28 is pivotally connected to the end frame 14 and the other end is pivotally connected to the coupler 26 proximate the bottom. The lift arms 28 rotate about the point of connection to the end frame 14, with the rotation of the lift arms 28 being controlled by corresponding lift cylinders 30 pivotally coupled to the end frame 14 and the lift arms 28. The lift cylinders 30 may be extended to raise the lift arms 28 and retracted to lower the lift arms 28. In typical implementations, two lift arms 28 are provided, with each having a corresponding lift cylinder 30. However, a single lift arm 28 and lift cylinder 30, two lift arms 28 driven by a single lift cylinder 30, or other arrangements of lift arms 28 and lift cylinders 30 providing similar functionality as kinematic elements may be implemented, and are contemplated by the inventors as having use in wheel loader machines in accordance with the present disclosure.

The rotation of the coupler 26 and attached implement may be controlled by a Z-bar linkage of the end frame 14. The Z-bar linkage may include a tilt lever 32 pivotally connected to a tilt lever support 34 mounted on the lift arms 28 such that the tilt lever support 34 moves with the lift arms 28. At one end of the tilt lever 32, a tilt link 36 has one end pivotally connected to the end of the tilt lever 32, and the opposite end pivotally connected to the coupler 26 proximate the top. A tilt cylinder 38 couples the opposite end of the tilt lever 32 to the end frame 14 with pivotal connections at either end. For a given position of the lift arms 28, the coupler 26 and implement are rotated toward the racked position by extending the tilt cylinder 38, and rotated in the opposite direction toward the dump position by retracting the tilt cylinder 38.

Figure 2:
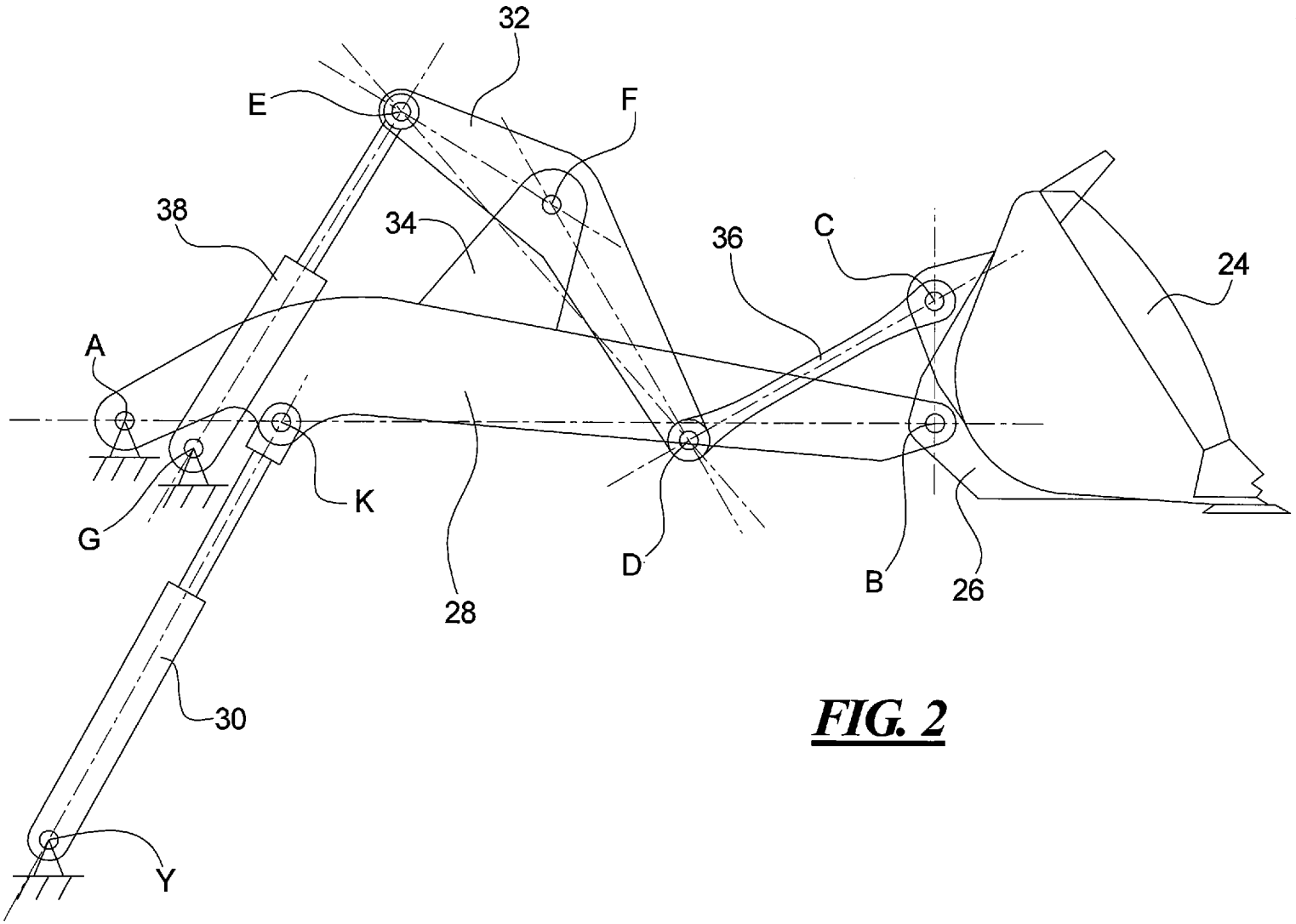
FIG. 2 is a schematic view of the kinematic elements controlling movement of the implements of the wheel loader machine of FIG. 1.

The kinematic arrangement of the elements controlling the movement of the implement is shown in FIG. 2. Each of the connections between the elements that move with respect to one another is made by a pivot pin about which the elements rotate. Consequently, the lift arms 28 may be connected to the end frame 14 by pivot pins A and to the coupler 26 by pivot pins B. The tilt link 36 may be connected to the coupler 26 by a pivot pin C and to the tilt lever 32 by a pivot pin D. The tilt lever 32 may be connected to the tilt cylinder 38 by a pivot pin E and to the tilt lever support 34 by a pivot pin F. The opposite end of the tilt cylinder 38 may be connected to the end frame 14 by a pivot pin G. Finally, the lift cylinders 30 may be connected to the lift arms 28 by pivot pins K and to the end frame 14 by pivot pins Y. Because the pivot pins A, G, Y are attached to the end frame 14, the distance between the pivot pins A, G, Y if fixed.

In the following discussion, the lengths of the elements will be designated by their pivot pins. With this convention, the lift arms 28 have a length AB, the tilt lever 32 has a length ED, the tilt link 36 has a length CD, the coupler 26 has a length BC, and so on. The lengths EG and KY of the tilt cylinder 38 and the lift cylinders 30, respectively, will vary as the corresponding rods are extended and retracted to maneuver the implement. As will be apparent to those skilled in the art, with the length EG of the tilt cylinder 38 held constant, the positions of the tilt lever 32, tilt link 36 and coupler 26 will change as the lift arms 28 are raised and lowered due to the change in the distance between the pivot pins F and G.

Wheel loader machines 10 in accordance with the present disclosure provide good performance for the bucket implement, and acceptable to good performance for the pallet fork implements. The performance is achieved with combinations of link lengths that have not been known in previous wheel loader machines implementing Z-bar linkages. In one embodiment, the improved performance may be achieved through a combination of increasing the length of the tilt link 36, moving the location of the pivot pin F closer to the pivot pin A, and moving the pivot pin G closer to and more directly beneath the pivot pin A, all in relation to the lengths of the other kinematic elements. In another embodiment, similar improved performance may be achieved through a combination of moving the pivot pin F closer to the midpoint between the pivot pins D and E, and moving the pivot pin G closer to and more directly beneath the pivot pin A in relation to the lengths of the other kinematic elements. These changes may be best illustrated by comparing various length ratios of the kinematic elements of the embodiments disclosed herein to those of previously known linkage arrangements. Table 1 lists various length ratios for two particular reference linkages, a range of length ratios for the reference linkages and a plurality of additional reference Z-bar linkages, and for two embodiments of Z-bar linkages in accordance with the present disclosure.

TABLE 1

| Length Ratio | Ref. Linkage 1 | Ref. Linkage 2 | Range for Ref. Z-bars Min | Max | New Linkage 1 | New Linkage 2 |
|---|---|---|---|---|---|---|
| Lift Arm v. F-Pin to Tilt Link (AB/DF) | 3.60 | 3.41 | 3.06 | 3.65 | 3.29-3.37 | **3.67-3.97** |
| Tilt Link v. Lift Arm (CD/AB) | 0.29 | 0.28 | 0.23 | 0.29 | **0.33-0.37** | 0.26-0.28 |
| Tilt Link v. F-Pin to A (CD/AF) | 0.42 | 0.45 | 0.33 | 0.45 | **0.54-0.60** | 0.40-0.43 |
| Tilt Link v. Implement (CD/BC) | 1.78 | 2.12 | 1.55 | 2.12 | **2.15-2.35** | 1.76-1.96 |
| Tilt Lever v. Tilt Link (DE/CD) | 1.65 | 1.89 | 1.60 | 2.36 | **1.44-1.59** | 1.72-1.92 |
| Tilt Lever v. F-Pin to Tilt Cyl. (DE/EF) | 2.31 | 2.23 | 2.23 | 2.35 | **2.08-2.21** | **2.08-2.21** |
| F-Pin to B v. F-Pin to A (BF/AF) | 0.60 | 0.71 | 0.58 | 0.74 | **0.77-0.86** | 0.62-0.64 |
| F-Pin to Tilt Cyl. v. F-Pin to Tilt Link (EF/DF) | 0.74 | 0.81 | 0.73 | 0.81 | 0.81 | **0.82-0.89** |
| G-Pin to A v. Tilt Link (AG/CD) | 0.52 | 0.34 | 0.34 | 0.61 | **0.31-0.33** | 0.40-0.45 |

The first column list a plurality of length ratios of the kinematic elements of the Z-bar linkages, the second and third columns provide values for the length ratios for two particular Z-bar linkages, the fourth and fifth columns provide minimum and maximum values, respectively, for the length ratios for the reference linkages and a plurality of additional linkages, and the sixth and seventh columns provide values or ranges of values for the length ratios for the embodiments of the new Z-bar linkage designs. The numbers in the sixth and seventh columns are shown in bold where the length ratios of the new linkages diverge from the ranges of the reference linkages.

For the embodiment of new linkage 1, the ratios illustrate the lengthening of the tilt link 36, and the shortening of the distances of the pivot pins G and F from pivot pin A. With reference to the tilt link 36, the increased length appears in the comparisons of the length CD of the tilt link 36 to the lengths AB, BC and DE of the lift arms 28, coupler 26 and tilt lever 32. For the reference linkages, the ratio of the tilt lever length DE to the tilt link length CD is in the range of 1.60-2.36. With the tilt link length CD decreased in new linkage 1 with respect to the tilt lever length DE, the ratio may be lowered to a value in the range of 1.44-1.59. The range may be further narrowed to 1.48-1.55, and in some embodiments may have a value of approximately 1.52. In the comparison of the tilt link length CD to the lift arm length AB, the ratio may increase to a value in the range of 0.33-0.37, and may have a value of approximately 0.35. The ratio of the tilt length CD to the coupler length BC may similarly increase, and may have a value in the range of 2.15-2.35, and may have a value of approximately 2.24.

For the distance AF from the pivot pin A to the pivot pin F, one relevant measure of the shortening of the distance AF is in the comparison of that distance to the distance BF from the pivot pin F to the pivot pin B at the opposite end of the lift arms 28. In the reference linkages, the ratio of the length BF to the length AF is in the range of 0.58-0.74. In new linkage 1, the ratio increases such that the length BF is more than 75% of the length AF, and may fall within the range of 0.77-0.86. In some embodiments, the ratio may fall within a narrower range of 0.79-0.84, and may have a value of approximately 0.80 or approximately 0.83. The combination of the shortening of the length AF and the increase in the tilt link length CD may further be illustrated by the increase in the ratio of the tilt link length CD to the length AF, which may increase to fall within the range of 0.54-0.60, which is above the reference maximum ratio of 0.45, and in various embodiments may have values of approximately 0.56 or approximately 0.58.

The changes in the location of the pivot pin G with respect to the location of the pivot pin A may be illustrated in the comparison of the length AG to the tilt link length CD, as well as in a change in the angle that a line between the pivot pins A and G makes with respect to horizontal line. Regarding the length AG, the reference linkages have the pivot pin G located a distance from the pivot pin A that is more than one third the length of the tilt link 36 (ratio AG/CD at least 0.34). The distance AG in new linkage 1 may be one third the length CD within the range of 0.31-0.33, and may have a value of approximately 0.33. Regarding the location of the pivot pin G, most of the reference linkages have the pivot pins G located on a line with the pivot pin A that is close to horizontal. For example, reference linkage 1 has a line AG that is approximately 1.1° above horizontal. In contrast, reference linkage 2 has a line AG that is below horizontal by approximately 38.0°. In the embodiment of new linkage 1, the line AG may be downward with respect to a horizontal line to place the pivot pin G below the pivot pin A, but may not be as extreme as the positioning of the pivot pin G in reference linkage 2. In various embodiments, the downward angle may be in the ranges of 20.0°-30.0° or 22.0°-27.0°, and may have a value of approximately 24.1°. The improvement in the performance of the embodiment of new linkage 1 over the reference linkages will be discussed further below.

For the embodiment of new linkage 2, the ratios illustrate the movement of the pivot pin F closer to the middle of the tilt lever 32. In the reference linkages, the ratio of the distances EF and DF from the pivot pin F to the tilt cylinder 38 and tilt link 36, respectively, has been in the range of 0.73-0.81, meaning that the pivot pin F is closer to the tilt cylinder 38 than the tilt link 36. In the embodiment of the new linkage 2, the pivot pin F may be moved closer to being equidistant between the ends of the tilt lever 32 such that the ratio EF/DF may increase to be within the range of 0.82-0.89, and may have a value of approximately 0.84. The change in this ratio may also be manifest in the ratios of the lift arm length AB to the distance from the pivot pin F to the tilt link 36 (increasing to within the range of 3.67-3.97, and may have values of approximately 3.72 or approximately 3.84), and the tilt lever length DE to the distance from the pivot pin F to the tilt cylinder 38 (decreasing to within the range of 2.08-2.21, and may have a value of approximately 2.18).

The changes in the location of the pivot pin G with respect to the location of the pivot pin A may be illustrated in a similar manner as discussed above for new linkage 1. The length AF may fall within the range of the reference linkages (ratio AG/CD in the range of 0.40-0.45), but the pivot pin G may be positioned lower than the pivot pin A. In the embodiment of new linkage 2, the line AG may be angled downward to place the pivot pin G below the pivot pin A, but may not be as extreme as the positioning of the pivot pin G in reference linkage 2. In various embodiments, the downward angle may be in the ranges of 15.0°-25.0° or 17.0°-22.0°, and may have a value of approximately 19.5°.

INDUSTRIAL APPLICABILITY

Figure 3:
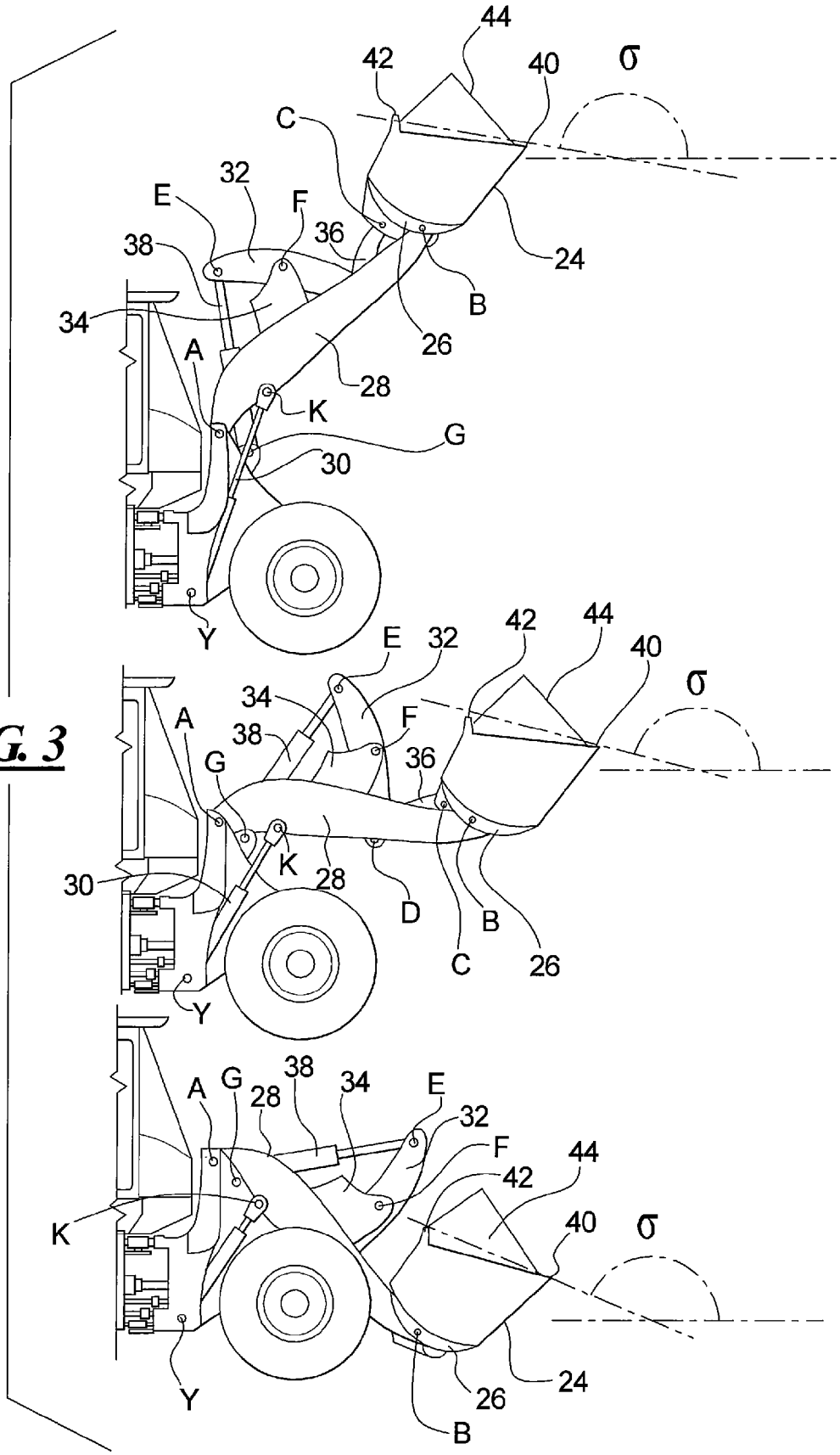
FIG. 3 is a partial side view of the wheel loader machine of FIG. 1 in a series of positions raising a racked bucket.

As discussed above, the Z-bar linkages in accordance with the present disclosure provide good performance when the bucket 28 is the implement connected to the coupler 26, and acceptable to good performance for the pallet fork implement. The performance improvements of the new Z-bar linkages for the bucket 28 may be illustrated by consideration of the ability of the scoop an optimal amount of loose material from a pile and transport the material in a stable manner. In this area, the change in the strike plane angle of the bucket 26 over the range of motion of the lift arms 28. Referring to FIG. 1, the bucket 24 includes a cutting edge 40 at the front of the bucket 24, and a spill guard 42 at the rear of the bucket 24. Referring to FIG. 3, the strike plane angle for the bucket 24 at a given position is the angle σ between a horizontal line and a line passing though the cutting edge 40 and the edge of the spill guard 42. Optimally, the strike plane angle σ is in the range of approximately 165°-175° so that spillage from the bucket 24 tends to fall over the cutting edge 40 instead of the over the spill guard 42. However, due to limitations inherent in the Z-bar linkages such as interference between the kinematic elements, the optimal strike plane angle σ may not be achievable through the entire range of motion of the lift arms 28.

Figure 4:
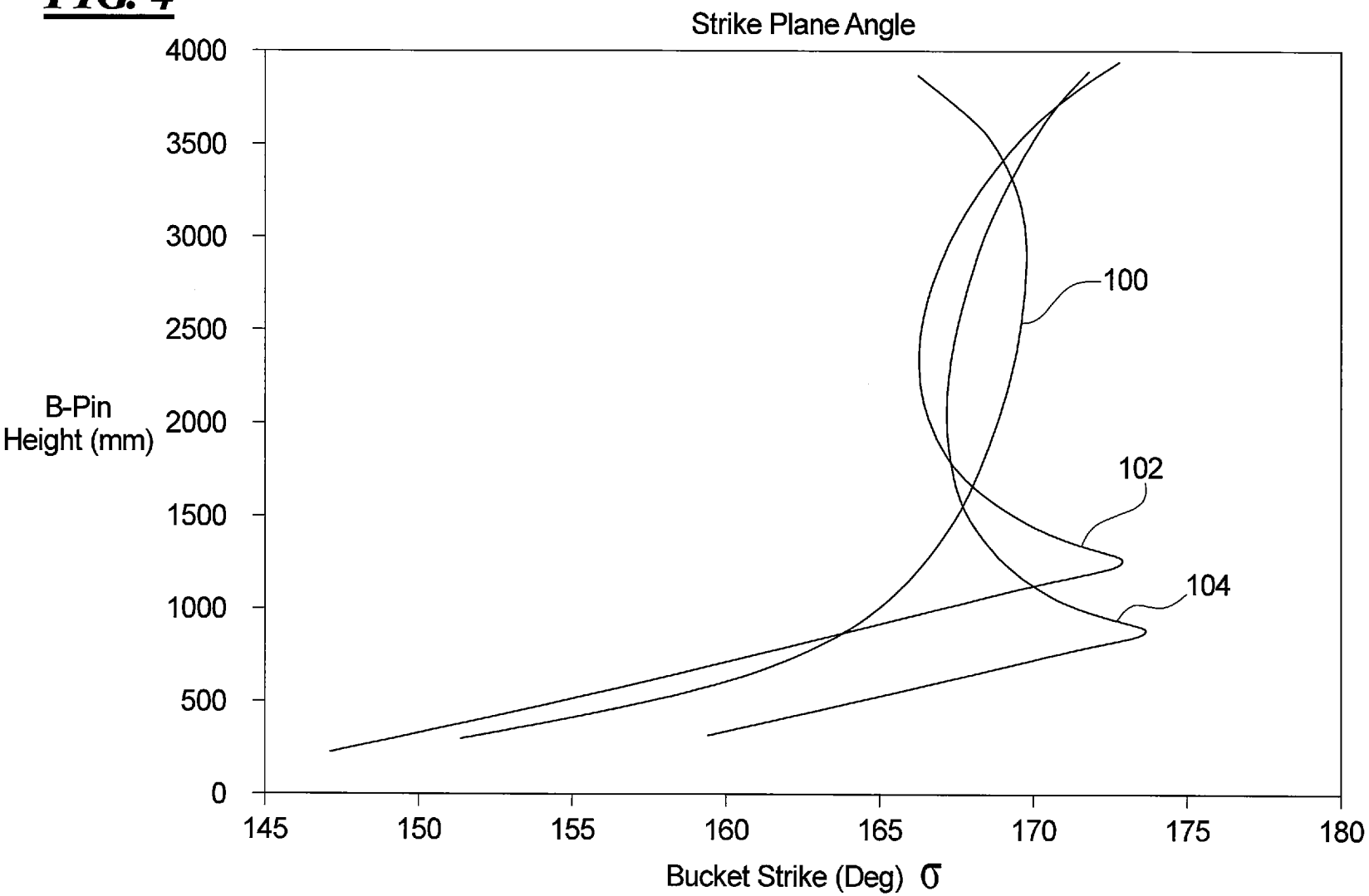
FIG. 4 is a graph of bucket strike plane angle change during lifting with curves for an embodiment of the wheel loader machine of FIG. 1 and two reference machines.

To compare the performances of the Z-bar linkages with regard to their achievable strike plane angle σ, the variation of the strike plane angle σ as the lift arms 28 raise the bucket 24 from ground level to its maximum height. As shown in FIG. 3 in the bottom illustration, in the initial position the lift arms 28 lower the bucket 24 to ground level and the tilt cylinder 38 is extended to rack the bucket 24 rearward to a maximum racked position. Once racked, the lift arms 28 raise the bucket 24 to the maximum height while the length EG of the tilt cylinder 38 remains constant as shown in the middle and top illustrations. FIG. 4 is graph of the strike plane angle σ versus the height of the pivot pin B for various Z-bar linkages. Curve 100 represents the performance of reference linkage 1 of Table 1, curve 102 represents the performance of reference linkage 2 of the Table 1, and curve 104 represent the performance of new linkage 1.

Curve 100 shows that reference linkage 1 does not reach the maximum strike plane angle σ until the bucket 24 is raised more than half way to its maximum height. Consequently, the bucket 24 will lift less material out of the pile the heaped material falls over the cutting edge 40 of the bucket 24. Curves 102, 104 for reference linkage 2 and new linkage 1, respectively, have generally similar shapes, but new linkage 1 has a greater maximum strike plane angle σ and reaches the maximum strike plane angle σ lower to the ground than reference linkage 1. Reference linkage 1 must raise the bucket 24 higher to achieve the same strike plane angle σ as new linkage 1, and therefore may not be able to scoop as much material out of smaller piles. Both reference linkage 1 and new linkage 1 decrease the strike plane angle σ as the buckets 24 are raised from the point of their maximum strike plane angles σ, but new linkage 1 allows the bucket 24 to be carried at a lower position to maintain as much of the load 44 as possible during transport to the dumping location. The lower carry position of new linkage 1 provides better stability of the wheel loader machine 10 when moving, and improved visibility for the operator over the top of the load 44. Depending on the configuration of the bucket 24, the operator may be able to see the cutting edge over the spill guard 42 when the bucket 24 is at the maximum strike plane angle σ to determine the fullness of the bucket 24 when less than a full load 44 is scooped from a pile.

Figure 5:
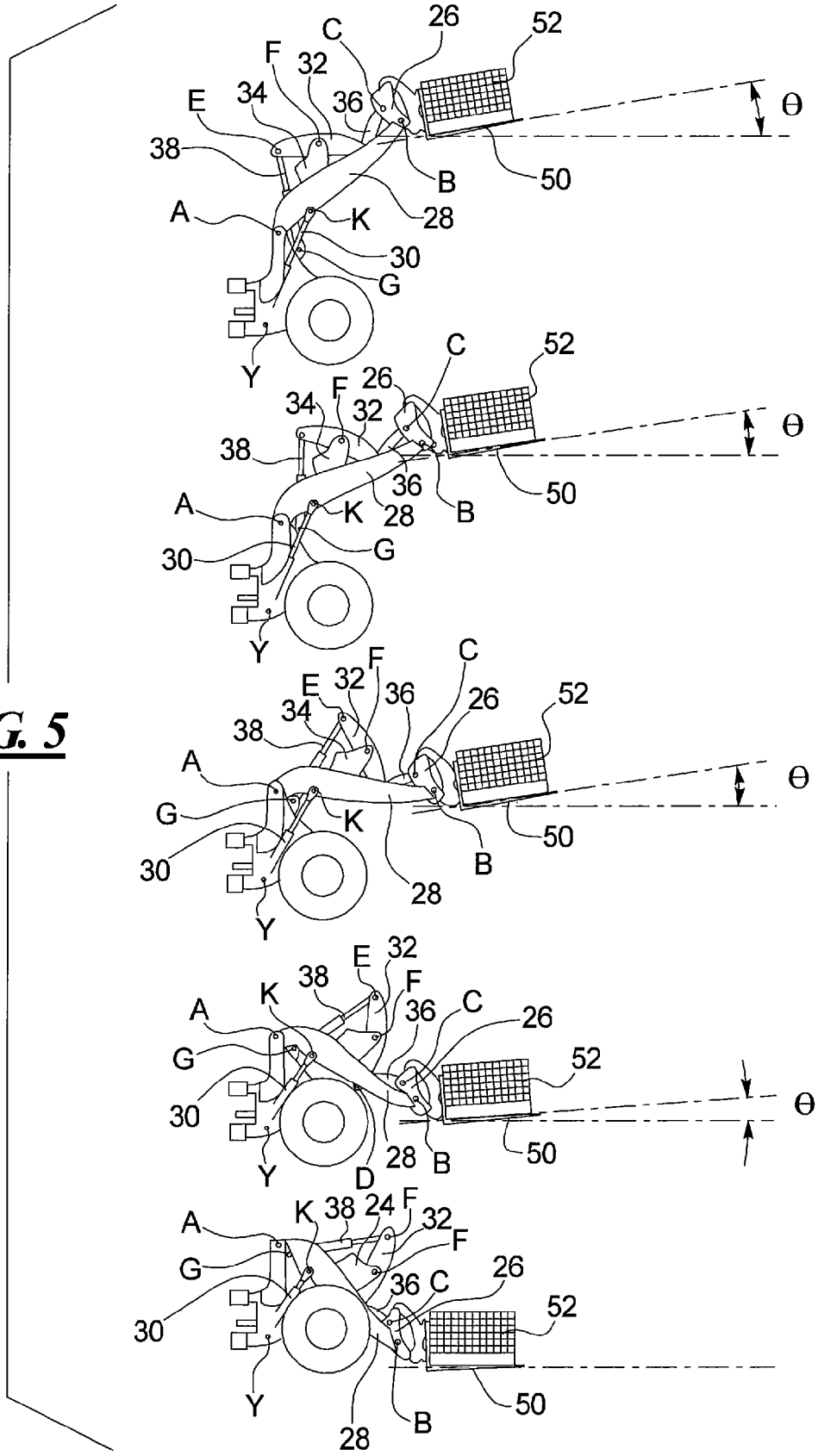
FIG. 5 is a partial side view of the wheel loader machine of FIG. 1 with pallet forks in a series of positions raising the pallets forks from a horizontal orientation at ground level.
Figure 6:
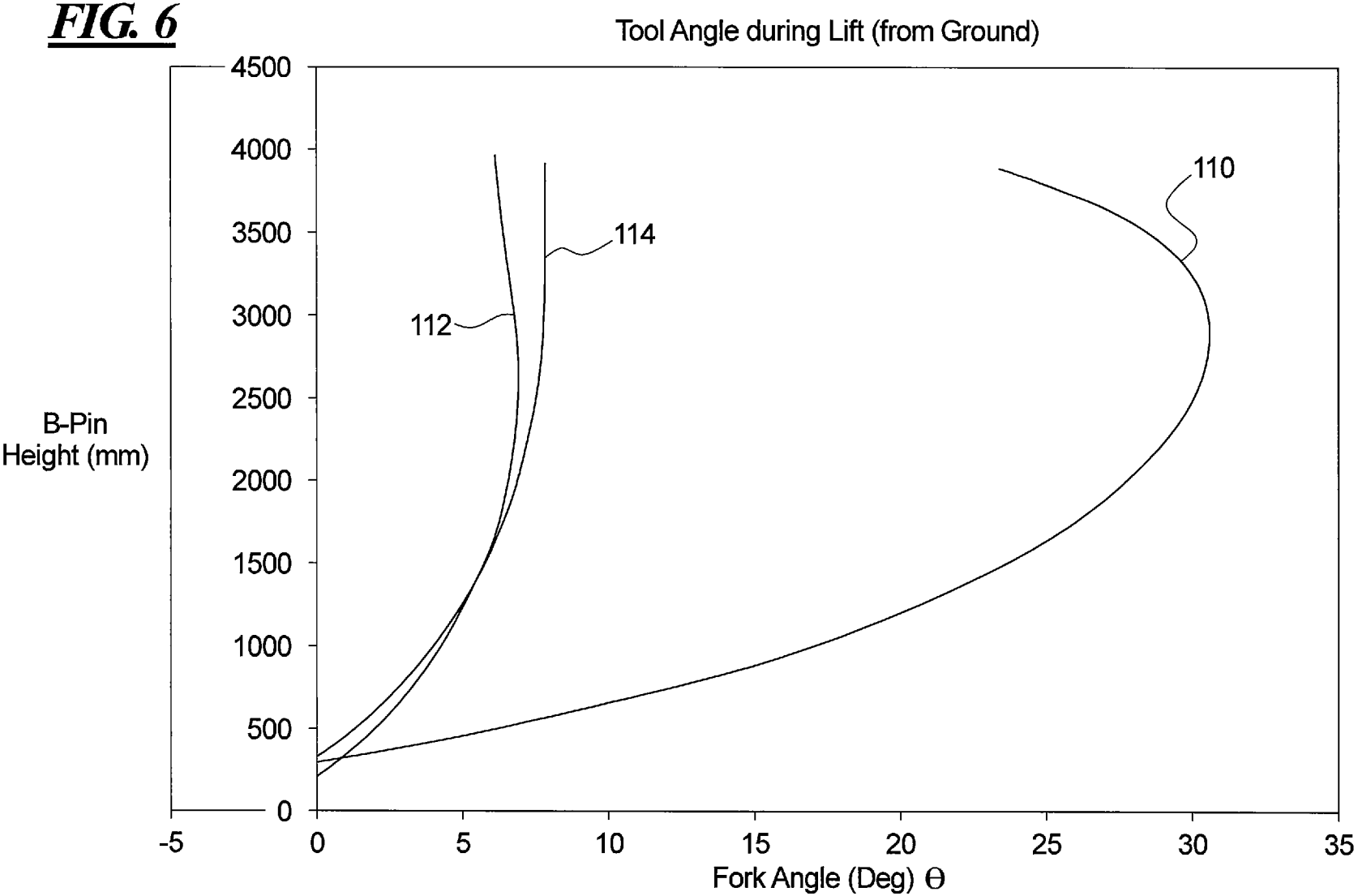
FIG. 6 is a graph of tool angle change during lifting with curves for an embodiment of the wheel loader machine of FIG. 1 and two reference machines.

Performances of various Z-bar linkage configurations with regard to fork implements may be evaluated by considering their ability to lift a load after the forks are horizontal at ground level. Referring to FIG. 5, a series of positions are illustrated wherein pallet forks 50 connected to the coupler 26 and having a container 52 disposed thereon is raised from ground level to a maximum height by the lift arms 28. As shown in the bottom illustration, in the initial position at ground level the tilt cylinder 38 is extended to a length wherein the pallet forks 50 are horizontal, and therefore have a fork angle θ of approximately 0°. As the lift arms 28 raise the bucket 24 to the maximum height while the length EG of the tilt cylinder 38 remains constant, the fork angle θ typically increases as shown in the subsequent illustrations. FIG. 6 is graph of the fork angle θ versus the height of the pivot pin B for the reference linkages 1 and 2 and new linkage 1. Curve 110 represents the performance of reference linkage 1, curve 112 represents the performance of reference linkage 2, and curve 114 represent the performance of new linkage 1.

Curve 110 shows that reference linkage 1 tilts the pallet forks 50 rearward to a fork angle θ of as much as approximately 30°. This may be acceptable for most loads carried on the pallet forks 50, but may result in instability for awkward loads that must remain upright. For reference linkage 2, curve 112 shows rotation of the pallet forks 50 to a fork angle θ of 6°-8°, but then a shallowing of the fork angle θ toward the horizontal position as the pallet forks 50 are raised higher. The shallowing of the pallet forks 50 may not present a problem when transporting containers. However, when transporting cylindrical loads, such as pipes or tree trunks, the shallower angle may increase the likelihood of the load rolling off the front of the pallet forks 50 when the wheel loader vehicle comes to a stop. As shown by curve 114, new linkage 1 tilts to a maximum fork angle θ of approximately 6°-8° at approximately the half way point of the lift, and then raises the pallet forks 50 to the maximum height with essentially a constant fork angle θ. By maintaining the fork angle θ and avoiding the shallowing of reference linkage 2, new linkage 1 maintains the stability of the load 52 and reduces the chance of the load 52 falling off the front of the pallet forks 50.

Another important consideration in evaluating the performance of Z-bar linkages is the load limit for the wheel loader machine 10 based on the configuration of the Z-bar linkage. For the wheel loader machines 10, there are three maximum load limits that are relevant for determining the maximum load that may be lifted. The first load limit, the tipping load limit, relates to the load at which the wheel loader machine 10 will tip forward over axle of the front wheels 22. The tip limit typically occurs at approximately the point where the lift arms 28 are parallel to the ground and thereby providing the maximum moment arm for rotation about the front wheel axle. Before the machine 10 tips forward, the operator may be able to feel that the load is close to or exceeds the tipping load, and may be able to lower the load or dump the load and avoid tipping the machine 10.

The second load limit, the lift load limit, relates to the load at which the lift cylinders 30 will stall when attempting to lift the load. Where standard size cylinders are used in the machines 10, the size of the load at which the lift cylinders 30 will stall at a given position will be determined, at least in part, on the relative positions of the lift cylinders 30 and lift arms 28, and the resulting mechanical advantage, or lack thereof, for the lift cylinders 30 in supporting the load on the lift arms 28. The less mechanical advantage, the smaller the load at which the lift cylinders 30 will hit the lift limit and stall. When the lift cylinders 30 stall, the lift cylinders 30 and, correspondingly, the load do not collapse, and instead are suspended in the air until the operator retracts tilt cylinder 30 to lower the load.

The final load limit, the tilt load limit, occurs when the load causes the tilt cylinder 38 to exceed a line relief point. The tilt cylinder 38 is provided with a release valve having a specified cylinder pressure at which the release valve opens to prevent damage to the tilt cylinder 28 and other linkage components. When the tilt limit is reached and the release valve opens, the depressurized tilt cylinder 28 can collapse and thereby allow the coupler 26 and implement to rotate forward about the pivot pin B and dump the load. The operator typically cannot feel when the tilt cylinder 38 will hit the relief point, and therefore cannot anticipate when the load may be dumped due to this load limit. Consequently, it may be preferable for the wheel loader machine 10 have a maximum load limit at either the tipping load limit or the lift load limit instead of at the tilt load limit.

Figure 7:
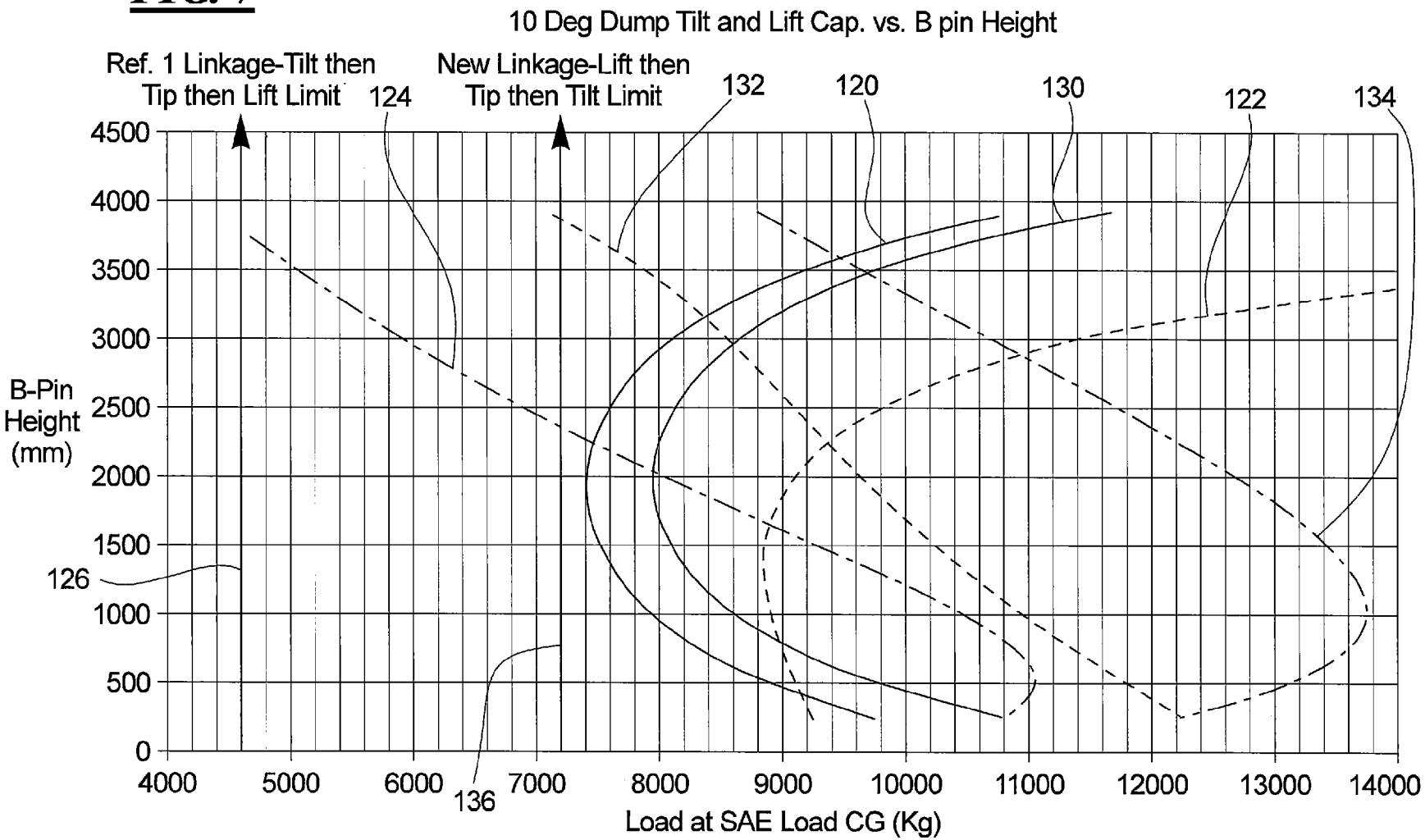
FIG. 7 is graph of machine tip up, tilt cylinder release and lift cylinder stall capacities during lifting with curves for an embodiment of the wheel loader machine of FIG. 1 and a first reference machine.
Figure 8:
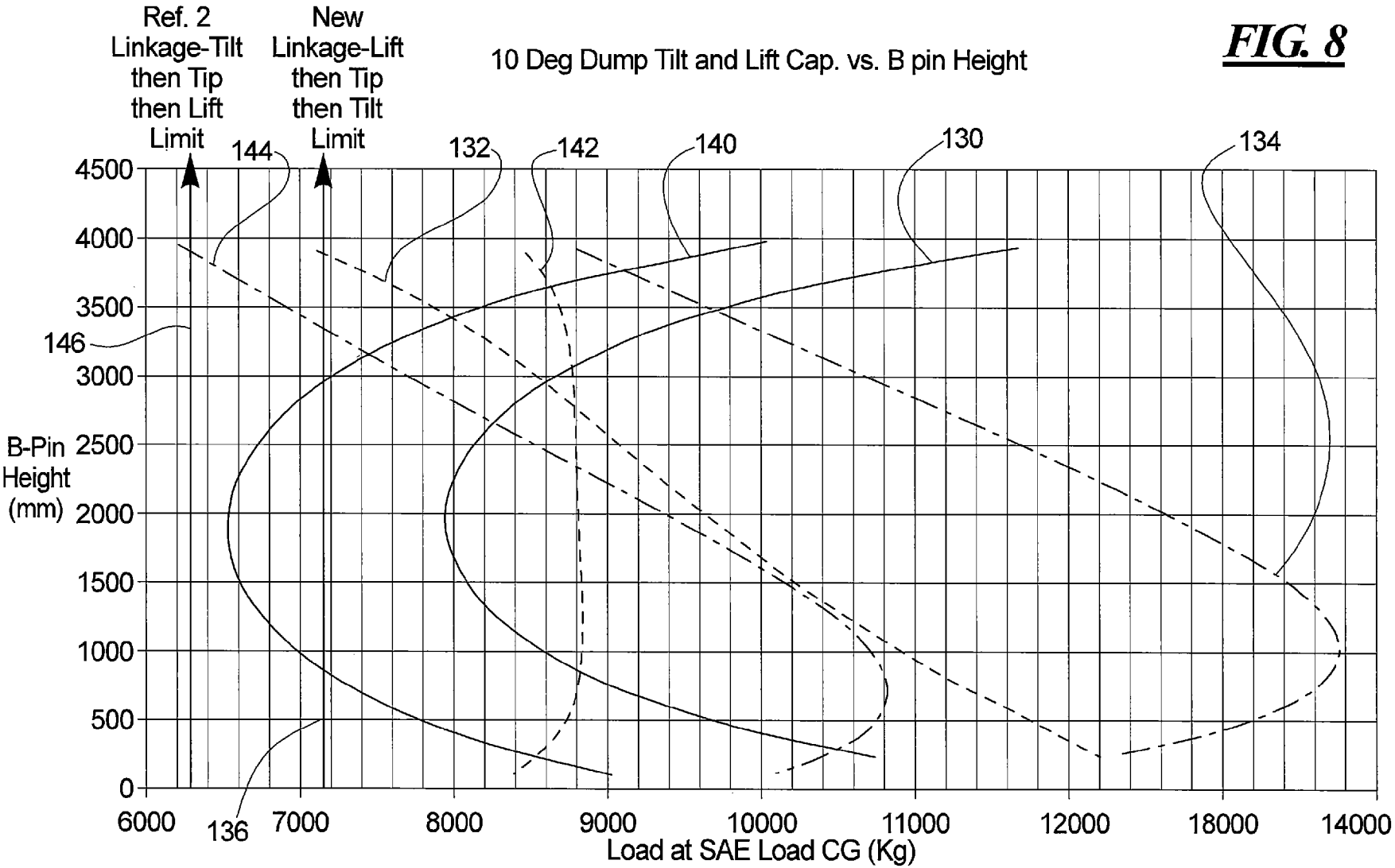
FIG. 8 is graph of tipping load, tilt cylinder release and lift cylinder stall capacities during lifting with curves for an embodiment of the wheel loader machine of FIG. 1 and a second reference machine.

The graphs of FIGS. 7 and 8 compare the performances of the reference linkages 1 and 2 and the new linkage 1 in terms of the three load limits to determine a maximum safe load for each. The graphs are based on a wheel loader machine 10 having pallet forks 50 maintained at a 10° downward tilt by adjusting the tilt cylinder 38 as the lift cylinder 30 raises the lift arms 28 from ground level to their maximum height. FIG. 7 presents the curves for reference linkage 1 and new linkage 1. Curve 120 is the tipping load limit curve, curve 122 is the lift limit curve, curve 124 is the tilt limit curve, and reference line 126 represents the load limit for reference linkage 1 based on the minimum safe load of the three load limits. Similarly, curve 130 is the tipping load limit curve, curve 132 is the lift limit curve, curve 134 is the tilt limit curve, and reference line 136 represents the load limit for new linkage 1.

For reference linkage 1, the tipping load limit is approximately 7,200 kg, the lift load limit is approximately 8,050 kg, and the tilt load limit is approximately 4,600 kg. Therefore, the maximum load limit for reference linkage 1 is approximately 4,600 kg. If the operator attempts to pick up a 7,300 kg load (which exceeds the maximum load limit for reference linkage 1, but is less than both the tipping load limit and the lift load limit), the load may be lifted past the point of the lift arms 28 being parallel to the ground. However, the machine 10 will drop the load when the pressure in the tilt cylinder 38 exceeds the relief point. In contrast, new linkage 1 has a tipping load limit of approximately 7,950 kg, a lift load limit of approximately 7,200 kg, and a tilt load limit of approximately 8,800 kg. Based on this, the maximum load limit for new linkage 1 is approximately 7,200 kg, or more than 50% greater than the load limit for reference linkage 1. When the lift arms 28 raise the implement with the 7,300 kg load, the machine 10 will not tip and the tilt cylinder 38 will not drop the load. Instead, the lift cylinders 30 may stall due to the weight of the load near the maximum lift height, but the load will remain suspended. At lower heights, the load may exceed the tipping limit, but tipping of the wheel loader machine 10 may be prevented by the operator if they feel the machine 10 reaching the tipping point. In either case, exceeding the maximum load limit with new linkage 1 is less catastrophic than the release of the tilt cylinder 38 as may be experienced in with reference linkage 1.

FIG. 8 provides the load limit comparisons between reference linkage 2 and new linkage 1. The curves 130-134 and line 136 from FIG. 7 are reproduced, and result in the load limits as discussed in the preceding paragraph. For reference linkage 2, curve 140 is the tipping limit curve, curve 142 is the lift limit curve, curve 144 is the tilt limit curve, and reference line 146 represents the load limit for reference linkage 2 based on the minimum load limit of the three maximum load limits. For reference linkage 2, the tipping load limit is approximately 6,525 kg, the lift load limit is approximately 8,200 kg, and the tilt load limit is approximately 6,275 kg. Therefore, the maximum load limit for reference linkage 1 is approximately 6,275 kg. As with reference linkage 1, the machine 10 implementing reference linkage 2 will drop its load when the tilt cylinder 38 hits the relief point if the lift arms 28 make it past the tipping load limit position, and will do so with a smaller load than would stall the lift cylinders 30 used in conjunction with new linkage 1.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed is:

1. A wheel loader machine, comprising:

an end frame;

a pair of lift arms having first ends pivotally connected to the end frame by pivot pins A having a common rotational axis and having second ends opposite the first ends;

a pair of lift cylinders having first ends pivotally connected to the end frame by pivot pins Y having a common rotational axis and second ends each pivotally connected to a corresponding one of the lift arms by pivot pins K having a common rotational axis, wherein extension of the lift cylinders causes the lift arms to pivot about the pivot pins A and move the second ends of the lift arms upwardly relative to the ground;

an implement having a material engaging portion and a coupling portion, where the second ends of the lift arms are pivotally connected to the implement proximate a bottom end of the coupling portion by pivot pins B having a common rotational axis;

a tilt lever having a first end and a second end, and being pivotally connected to the lift arms at a point between the first and second ends of the tilt lever by a pivot pin F;

a tilt link having a first end pivotally connected to the second end of the tilt lever by a pivot pin D and second end pivotally connected to the implement proximate a top end of the coupling portion by a pivot pin C; and a tilt cylinder having a first end pivotally connected to the first end of the tilt lever by a pivot pin E and a second end pivotally connected to the end frame by a pivot pin G, wherein extension of the tilt cylinder causes the tilt lever and tilt link to rotate the implement about the pivot pins B toward a racked position, wherein a ratio of a distance DE between the pivot pins D and E to a distance EF between the pivot pins E and F is in the range of 2.08-2.21.

2. The wheel loader machine of claim 1, wherein the ratio of the distance DE to the distance EF is approximately 2.18.

3. The wheel loader machine of claim 1, wherein a ratio of the distance EF to a distance DF between the pivot pins D and F is in the range of 0.82-0.89.

4. The wheel loader machine of claim 3, wherein the ratio of the distance EF to the distance DF is approximately 0.84.

5. The wheel loader machine of claim 1, wherein a ratio of a distance AB between the pivot pins A and B to the distance DF is in the range of 3.67-3.97.

6. The wheel loader machine of claim 5, wherein the ratio of the distance AB to the distance DF is one of approximately 3.72 and approximately 3.84.

7. The wheel loader machine of claim 1, wherein a downward angle of a line AG extending between the pivot pins A and G and a horizontal line is in the range of 15.0°-25.0°.

8. The wheel loader machine of claim 7, wherein the downward angle of the line AG and the horizontal line is approximately 19.5°.

9. The wheel loader machine of claim 1, wherein a ratio of the distance DE to a distance CD between the pivot pins C and D is in the range of 1.44-1.59.

10. The wheel loader machine of claim 9, wherein the ratio of the distance DE to the distance CD is approximately 1.52.

11. The wheel loader machine of claim 1, wherein the ratio of a distance BF between the pivot pins B and F to a distance AF between the pivot pins A and F is in the range of 0.77-0.86.

12. The wheel loader machine of claim 11, wherein the ratio of the distance BF to the distance AF is one of approximately 0.80 and approximately 0.83.

13. The wheel loader machine of claim 1, wherein a downward angle of a line AG extending between the pivot pins A and G and a horizontal line is in the range of 20.0°-30.0°.

14. The wheel loader machine of claim 13, wherein the downward angle of the line AG and the horizontal line is approximately 24.1°.

15. The wheel loader machine of claim 1, wherein the ratio of a distance CD between the pivot pins C and D to a distance AB between the pivot pins A and B is in the range of 0.33-0.37.

16. The wheel loader machine of claim 1, wherein the ratio of a distance CD between the pivot pins C and D to a distance BC between the pivot pins B and C is in the range of 2.15-2.35.

17. A wheel loader machine, comprising:

an end frame;

a pair of lift arms having first ends pivotally connected to the end frame by pivot pins A having a common rotational axis and having second ends opposite the first ends;

a pair of lift cylinders having first ends pivotally connected to the end frame by pivot pins Y having a common rotational axis and second ends each pivotally connected to a corresponding one of the lift arms by pivot pins K having a common rotational axis, wherein extension of the lift cylinders causes the lift arms to pivot about the pivot pins A and move the second ends of the lift arms upwardly relative to the ground;

an implement having a material engaging portion and a coupling portion, where the second ends of the lift arms are pivotally connected to the implement proximate a bottom end of the coupling portion by pivot pins B having a common rotational axis;

a tilt lever having a first end and a second end, and being pivotally connected to the lift arms at a point between the first and second ends of the tilt lever by a pivot pin F;

a tilt link having a first end pivotally connected to the second end of the tilt lever by a pivot pin D and second end pivotally connected to the implement proximate a top end of the coupling portion by a pivot pin C; and a tilt cylinder having a first end pivotally connected to the first end of the tilt lever by a pivot pin E and a second end pivotally connected to the end frame by a pivot pin G, wherein extension of the tilt cylinder causes the tilt lever and tilt link to rotate the implement about the pivot pins B toward a racked position, wherein a ratio of a distance DE between the pivot pins D and E to a distance CD between the pivot pins C and D is in the range of 1.44-1.59.

18. The wheel loader machine of claim 17, wherein the ratio of the distance DE to the distance CD is approximately 1.52.

19. The wheel loader machine of claim 17, wherein the ratio of a distance BF between the pivot pins B and F to a distance AF between the pivot pins A and F is in the range of 0.77-0.86.

20. The wheel loader machine of claim 19, wherein the ratio of the distance BF to the distance AF is one of approximately 0.80 and approximately 0.83.

21. The wheel loader machine of claim 17, wherein a downward angle of a line AG extending between the pivot pins A and G and a horizontal line is in the range of 20.0°-30.0°.

22. The wheel loader machine of claim 21, wherein the downward angle of the line AG and the horizontal line is approximately 24.1°.

23. A wheel loader machine, comprising:

an end frame;

a pair of lift arms having first ends pivotally connected to the end frame by pivot pins A having a common rotational axis and having second ends opposite the first ends;

a pair of lift cylinders having first ends pivotally connected to the end frame by pivot pins Y having a common rotational axis and second ends each pivotally connected to a corresponding one of the lift arms by pivot pins K having a common rotational axis, wherein extension of the lift cylinders causes the lift arms to pivot about the pivot pins A and move the second ends of the lift arms upwardly relative to the ground;

an implement having a material engaging portion and a coupling portion, where the second ends of the lift arms are pivotally connected to the implement proximate a bottom end of the coupling portion by pivot pins B having a common rotational axis;

a tilt lever having a first end and a second end, and being pivotally connected to the lift arms at a point between the first and second ends of the tilt lever by a pivot pin F;

a tilt link having a first end pivotally connected to the second end of the tilt lever by a pivot pin D and second end pivotally connected to the implement proximate a top end of the coupling portion by a pivot pin C; and a tilt cylinder having a first end pivotally connected to the first end of the tilt lever by a pivot pin E and a second end pivotally connected to the end frame by a pivot pin G, wherein extension of the tilt cylinder causes the tilt lever and tilt link to rotate the implement about the pivot pins B toward a racked position, wherein a ratio of a distance EF between the pivot pins E and F to a distance DF between the pivot pins D and F is in the range of 0.82-0.89.

24. The wheel loader machine of claim 23, wherein the ratio of the distance EF to the distance DF is approximately 0.84.

25. The wheel loader machine of claim 23, wherein a ratio of a distance AB between the pivot pins A and B to the distance DF is in the range of 3.67-3.97.

26. The wheel loader machine of claim 25, wherein the ratio of the distance AB to the distance DF is one of approximately 3.72 and approximately 3.84.

27. The wheel loader machine of claim 23, wherein a downward angle of a line AG extending between the pivot pins A and G and a horizontal line is in the range of 15.0°-25.0°.

28. The wheel loader machine of claim 27, wherein the downward angle of the line AG and the horizontal line is approximately 19.5°.

* * * * *